US010907393B2

(12) United States Patent
Leng

(10) Patent No.: US 10,907,393 B2
(45) Date of Patent: Feb. 2, 2021

(54) CABINET

(71) Applicant: New-Tec Integration (Xiamen) Co., Ltd., Xiamen (CN)

(72) Inventor: Luhao Leng, Xiamen (CN)

(73) Assignee: New-Tec Integration (Xiamen) Co., Ltd., Xiamen (CN)

( * ) Notice: Subject to any disclaimer, the term of this patent is extended or adjusted under 35 U.S.C. 154(b) by 0 days.

(21) Appl. No.: 16/794,175

(22) Filed: Feb. 18, 2020

(65) Prior Publication Data

US 2020/0263474 A1 Aug. 20, 2020

(30) Foreign Application Priority Data

Feb. 18, 2019 (CN) ..... 2019 2 0207066 U

(51) Int. Cl.
*E05F 5/10* (2006.01)

(52) U.S. Cl.
CPC ..... *E05F 5/10* (2013.01); *E05Y 2900/20* (2013.01)

(58) Field of Classification Search
CPC .... A47B 67/00; E05F 5/10; E05F 5/00; E05F 5/06; E05F 5/08; E05Y 2900/20; B65D 43/16; B65D 43/163; B65D 43/164; E05C 17/30
USPC ..... 312/327, 328, 319.1, 319.2, 319.8; 220/810, 827, 831, 832
See application file for complete search history.

(56) References Cited

U.S. PATENT DOCUMENTS 7,290,370 B2 * 11/2007 McCullough ..... E05F 1/1075 49/386
8,689,992 B2 * 4/2014 Anderson ..... A47C 7/62 217/12 R
2015/0123530 A1 * 5/2015 Boewe ..... A47B 47/025 312/327

FOREIGN PATENT DOCUMENTS

WO WO-2019170619 A1 * 9/2019 ..... E05D 11/1021

* cited by examiner

*Primary Examiner* — Andrew M Roersma
(74) *Attorney, Agent, or Firm* — Cooper Legal Group, LLC

(57) ABSTRACT

The present disclosure discloses cabinet. The cabinet comprises a cabinet body with a top opening, an upper cover, a swinging member, and a pneumatic rod. A middle portion of a bottom surface of the upper cover comprises a first reinforcing rod extending in a front-rear direction, and a hinge element is disposed on the first reinforcing rod. A middle portion of an inner surface of a rear board of the cabinet body is disposed with a second reinforcing rod extending in a vertical direction. A connection base is disposed on an upper end of the second reinforcing rod. Two ends of the swinging member are respectively pivotally connected to the connection base and a lower end of the pneumatic rod, and an upper end of the pneumatic rod is pivotally connected to the hinge element.

6 Claims, 4 Drawing Sheets

CABINET

RELATED APPLICATIONS

This application claims priority to Chinese Patent Application 201920207066.6, filed on Feb. 18, 2019, which is incorporated herein by reference.

FIELD OF THE DISCLOSURE

The present disclosure relates to a cabinet, and in particular relates to a cabinet having a positionable upper cover.

BACKGROUND OF THE DISCLOSURE

Storage cabinets, also referred to herein as cabinets, are usually a hollow, rectangular-shaped or square-shaped box structure, and a top surface of the cabinets is configured to be opened and closed freely, thereby functioning as an upper cover. Traditional storage cabinets comprise no position assemblies for keeping the upper cover at a set position upon being opened. When the upper cover is opened, the upper cover is rotated to a back side of the cabinets and hangs down naturally. Therefore, a degree to which the upper cover rotates when being opened or closed is large, and opening or closing the upper cover is laborious. Even when a cabinet is small, the cabinet can barely be operated by a person standing in front of the cabinet. When a cabinet is large, the arms of a person standing in front of the cabinet are not long enough to directly operate the cabinet. Instead, the person needs to move to a side of the cabinet to open or close the upper cover, and therefore the operation is not convenient. In order to open the upper cover of large-sized cabinets conveniently, some people have created cabinets with position assemblies for opening the upper cover. However, the existing cabinets simply use a support rod to support the opened upper cover. If the upper cover is accidently touched, the support rod easily falls down, and the upper cover falls down too due to the lack of support. The upper cover can hurt the user when falling, or an impact force of the falling upper cover can be great enough to cause a connection between the upper cover and the cabinet to break.

BRIEF SUMMARY OF THE DISCLOSURE

The present disclosure provides a cabinet having a positionable upper cover to solve deficiencies of the background techniques. In order to solve the aforementioned technical problems, a technical solution of the present disclosure is as follows.

A cabinet comprises a cabinet body with a top opening, an upper cover, a swinging member, and a pneumatic rod. A rear board of the upper cover is pivotally connected with a rear board of the cabinet body, and the upper cover is configured to be opened and to be closed to cover the top opening. A middle portion of a bottom surface of the upper cover comprises a first reinforcing rod extending in a front-rear direction, and a hinge element is disposed on the first reinforcing rod. A middle portion of an inner surface of the rear board of the cabinet body is disposed with a second reinforcing rod extending in a vertical direction. A connection base is disposed on an upper end of the second reinforcing rod. Two ends of the swinging member are respectively pivotally connected to the connection base and a lower end of the pneumatic rod, and an upper end of the pneumatic rod is pivotally connected to the hinge element.

In another preferred embodiment, a middle portion of the connection base comprises an aisle, the aisle extends forward and obliquely upward in the connection base, and the swinging member is disposed in the aisle.

In another preferred embodiment, a bottom surface of the aisle is inclined. When the pneumatic rod extends, the swinging member is supported on the bottom surface of the aisle, and the upper cover is opened. When the pneumatic rod retracts, the swinging member rotates upward, and the upper cover is closed.

In another preferred embodiment, the pneumatic rod comprises a housing and a movable rod. A lower end of the housing is pivotally connected to the swinging member, and an upper end of the movable rod is pivotally connected to the hinge element.

In another preferred embodiment, the cabinet body further comprises a bottom board, a left board, a right board, a front board, and the rear board.

In another preferred embodiment, the swinging member rotates in a vertical plane.

Compared with the background art, this technical solution has the following advantages:

1. The upper cover is disposed with the hinge element, and a first end (e.g., the lower end) of the pneumatic rod is pivotally connected to the hinge element. The cabinet body comprises the connection base, and a second end (e.g., the upper end) of the pneumatic rod is pivotally connected to the connection base by the swinging member. When the upper cover is opened or closed, the swinging member rotates to adjust a position of the lower end of the pneumatic rod, and the pneumatic rod extends or retracts at the same time to stably support the upper cover. In this way, the upper cover is stably opened or closed.

2. The swinging member is disposed in the aisle. The aisle extends forward and obliquely upwards in the connection base. The swinging member rotates in a vertical plane, which is consistent with an opening and closing direction of the upper cover, and an operation of the upper cover is easier.

BRIEF DESCRIPTION OF THE DRAWING

The present disclosure will be further described below with the combination with the accompanying drawings and the embodiments.

DETAILED DESCRIPTION OF THE EMBODIMENTS

Embodiment 1

Figure 1:
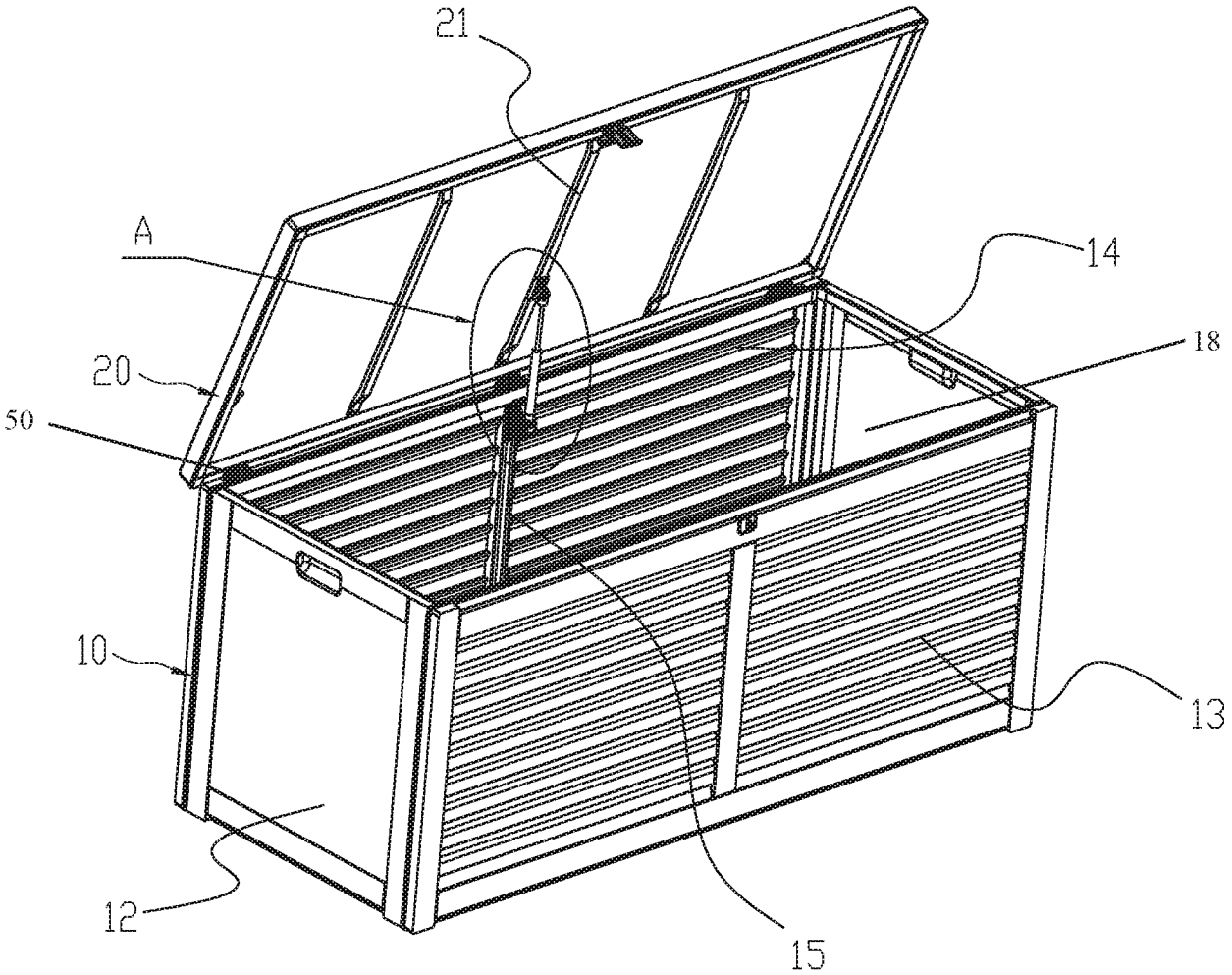
FIG. 1 illustrates a schematic view of a cabinet with a position assembly for opening a cover of Embodiment 1 of the present disclosure.
Figure 2:
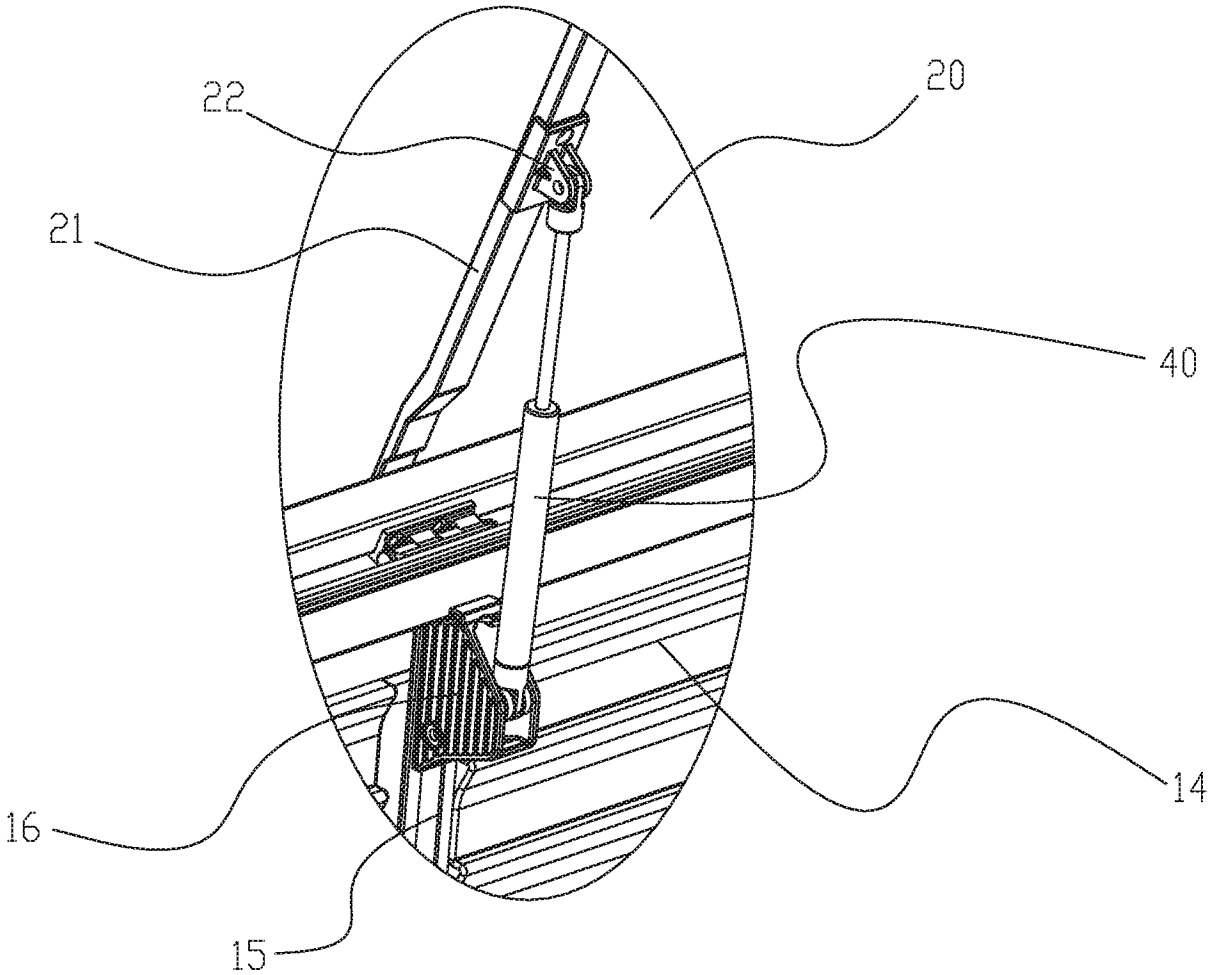
FIG. 2 illustrates an enlarged schematic view of the portion of the cabinet labeled "A" in FIG. 1.
Figure 3:
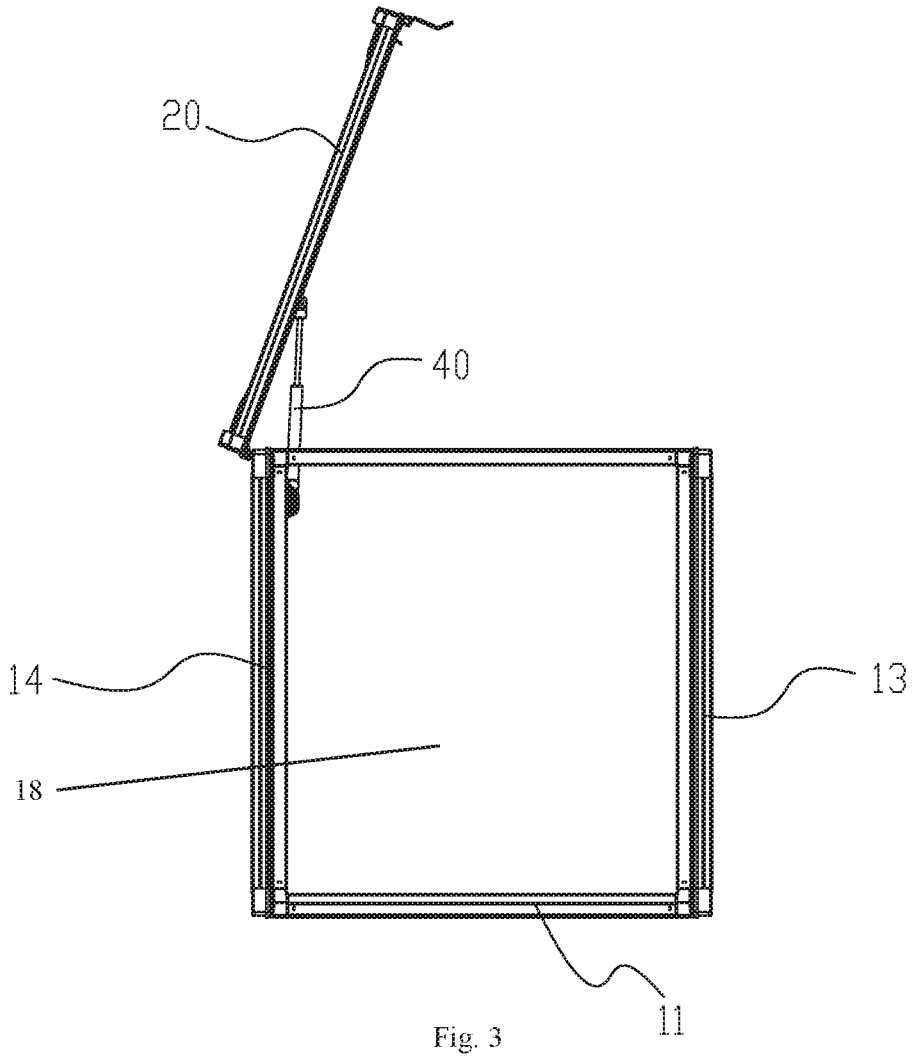
FIG. 3 illustrates a side view of the cabinet with the position assembly for opening the cover shown in FIG. 1.
Figure 4:
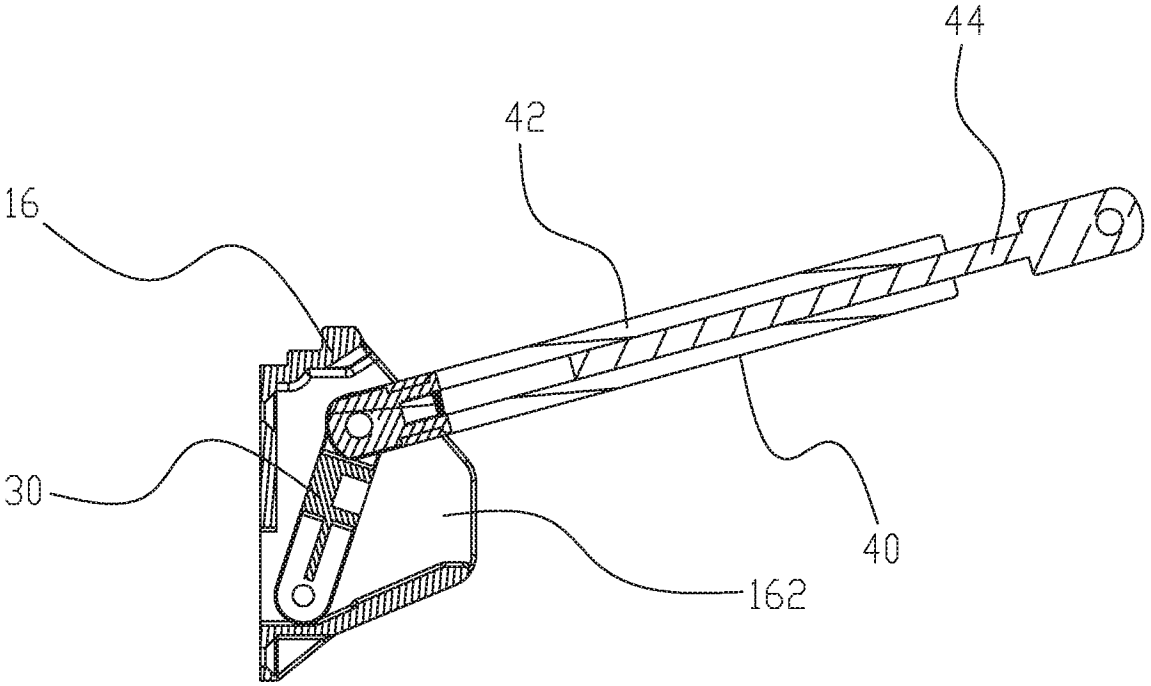
FIG. 4 illustrates a schematic view of a connection of the connection base, the swinging member, and the pneumatic rod.

Referring to FIGS. 1-4, a cabinet with a position assembly for opening an upper cover 20 comprises a cabinet body 10 with a top opening 18 and the upper cover 20. The cabinet body 10 comprises a bottom board 11, a left board 12, a right board 12, a front board 13, and a rear board 14. A rear board of the upper cover 20 is pivotally connected with the rear board 14 of the cabinet body 10 adjacent to the top opening 18 of the cabinet body 10 so that the upper cover 20 is configured to be opened and to be closed to cover the top opening 18. The upper cover 20 is pivotally connected to the cabinet body 10 by a hinge 50. A middle portion of a bottom surface of the upper cover 20 comprises a first reinforcing rod 21 extending in a front-rear direction, and a hinge element 22 is disposed on the first reinforcing rod 21. A middle portion of an inner surface of the rear board 14 of the cabinet body 10 is disposed with a second reinforcing rod 15 extending in a vertical direction. A connection base 16 is disposed on an upper end of the second reinforcing rod 15. The cabinet further comprises a swinging member 30 and a pneumatic rod 40. Two ends of the swinging member 30 are respectively pivotally connected to the connection base 16 and a lower end of the pneumatic rod 40, and an upper end of the pneumatic rod 40 is pivotally connected to the hinge element 22. When the upper cover 20 is opened or closed, the pneumatic rod 40 extends or retracts correspondingly to support the upper cover 20, and the swinging member 30 rotates correspondingly to adjust a position of the lower end of the pneumatic rod 40.

In some embodiments, a middle portion of the connection base 16 comprises an aisle 162. The aisle 162 extends forward and obliquely upward in the connection base 16, and the swinging member 30 is disposed in the aisle 162. A bottom surface of the aisle 162 is inclined. When the pneumatic rod 40 extends, the swinging member 30 is supported on the bottom surface of the aisle 162, and the upper cover 20 is opened synchronously. When the pneumatic rod 40 retracts, the swinging member 30 rotates upward, and the upper cover 20 is closed synchronously.

In some embodiments, the pneumatic rod 40 comprises a housing 42 and a movable rod 44. A lower end of the housing 42 is pivotally connected to the swinging member 30, and an upper end of the movable rod 44 is pivotally connected to the hinge element 22.

Although the present disclosure has been described with reference to the preferred embodiments, it will be apparent to those skilled in the art that various modifications and variations can be made in the present disclosure without departing from the spirit or scope of the invention. Thus, it is intended that the present disclosure cover the modifications and variations of this invention provided they come within the scope of the appended claims and their equivalents.

What is claimed is:

1. A cabinet, comprising:

a cabinet body with a top opening, an upper cover, a swinging member, and a pneumatic rod, wherein:

a rear board of the upper cover is pivotally connected with a rear board of the cabinet body, the upper cover is configured to be opened and to be closed to cover the top opening, a middle portion of a bottom surface of the upper cover comprises a first reinforcing rod extending in a front-rear direction, a hinge element is disposed on the first reinforcing rod, a middle portion of an inner surface of the rear board of the cabinet body is disposed with a second reinforcing rod extending in a vertical direction, a connection base is disposed on an upper top end of the second reinforcing rod, two ends of the swinging member are respectively pivotally connected to the connection base and a lower end of the pneumatic rod, and an upper end of the pneumatic rod is pivotally connected to the hinge element.

2. The cabinet according to claim 1, wherein:

a middle portion of the connection base comprises an aisle, the aisle extends forward and obliquely upward in the connection base, and the swinging member is disposed in the aisle.

3. The cabinet according to claim 2, wherein:

a bottom surface of the aisle is inclined, when the pneumatic rod extends:

the swinging member is supported on the bottom surface of the aisle, and the upper cover is opened, and when the pneumatic rod retracts:

the swinging member rotates upward, and the upper cover is closed.

4. The cabinet according to claim 1, wherein:

the pneumatic rod comprises a housing and a movable rod, a lower end of the housing is pivotally connected to the swinging member, and an upper end of the movable rod is pivotally connected to the hinge element.

5. The cabinet according to claim 1, wherein the cabinet body comprises a bottom board, a left board, a right board, a front board, and the rear board.

6. The cabinet according to claim 1, wherein the swinging member rotates in a vertical plane.

* * * * *